US005351892A

United States Patent [19]

Conte

[11] Patent Number: 5,351,892

[45] Date of Patent: Oct. 4, 1994

[54] UNITARY, MULTI-PURPOSE, SELF-CONTAINED SELECTION, DILUTION, MIXING AND DISPENSING APPARATUS

[76] Inventor: Nicholas P. Conte, 288 Central Ave., Jersey City, N.J. 07307

[21] Appl. No.: 135,305

[22] Filed: Sep. 30, 1993

[51] Int. Cl.[5] ..... B05B 7/30

[52] U.S. Cl. ..... 239/304; 239/310; 239/414; 239/416.1; 239/416.2

[58] Field of Search ..... 239/303, 304, 307, 310, 239/110, 407, 413, 414, 416.1, 416.2, 305; 222/133, 145, 180, 181

[56] References Cited

U.S. PATENT DOCUMENTS

| | | | |
|---|---|---|---|
| 3,086,379 | 4/1963 | Plante | 222/133 X |
| 3,333,601 | 8/1967 | Lofgreen | 239/318 X |
| 3,445,067 | 5/1969 | Sheldall | 239/318 |
| 3,486,695 | 12/1969 | Novak | 239/304 X |
| 3,720,352 | 3/1973 | Kozlowski | 239/310 X |
| 3,917,172 | 11/1975 | O'Hare | 239/307 X |
| 4,218,013 | 8/1980 | Davison | 239/318 X |
| 4,295,612 | 10/1981 | Betsinger et al. | 239/310 |
| 4,881,575 | 11/1989 | Smith | 239/307 X |

*Primary Examiner*—William Grant
*Attorney, Agent, or Firm*—Stephen W. White

[57] ABSTRACT

A unitary, multi-purpose, self-contained apparatus for the selection, variable dilution, mixing and dispensing of one or more fluids into a diluent stream is described. This apparatus is made from two, complimentary halves which describe the various reservoirs, line feeds, and valves used to add these fluids to an incoming diluent stream. The apparatus can be used in combination with a shower, bath, sink faucet, hose, washing machine, and dish washer and can be used to dispense soaps, shampoos, detergents, and disinfectants, or also fertilizers, insecticides and the like. The apparatus can also be used in the embalming and medical field as well as to select, dilute, mix and dispense ingredients to prepare coffee and sodas, in coin operated dispensing machines.

6 Claims, 6 Drawing Sheets

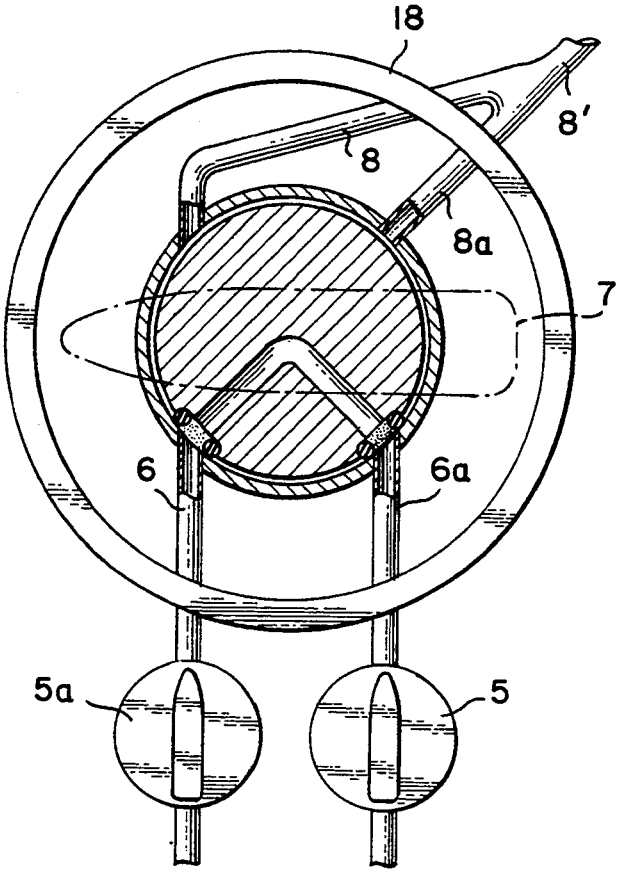
FIG. 6
FIG. 5
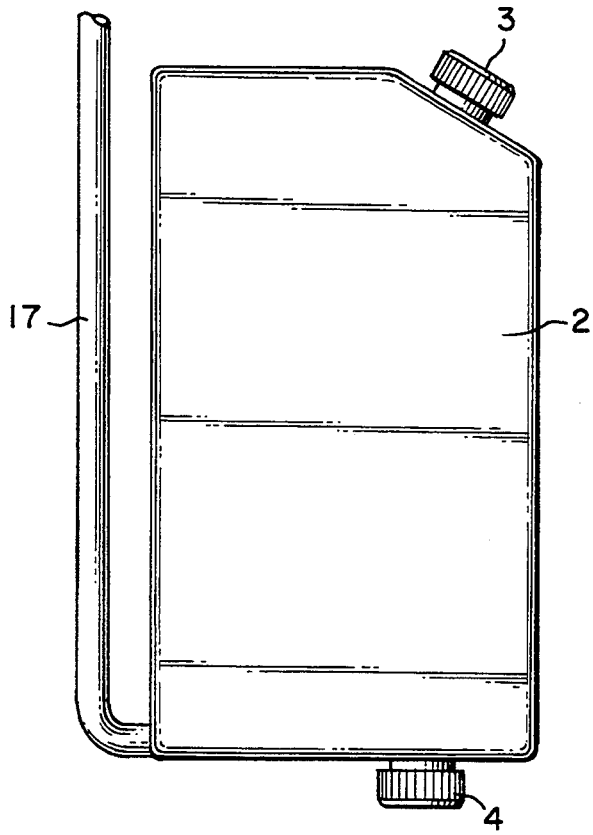

UNITARY, MULTI-PURPOSE, SELF-CONTAINED SELECTION, DILUTION, MIXING AND DISPENSING APPARATUS

BACKGROUND OF THE INVENTION

1. Field of the Invention

This invention relates to an apparatus that can be used to select, dilute, mix and dispense multiple solutions, liquids, semi-liquids or other such elements. More specifically, this invention relates to an apparatus that can be used to variably dilute, mix and then dispense a multiplicity of desired solutions or elements. Even more specifically, this invention relates to a unique, unitary unit that can conveniently and rapidly mix, dilute at various dilution ratios and dispense any desired solution or element and can be fabricated from a simple and integrated pre-formed element so as to save cost in the manufacture thereof.

2. Description of the Prior Art

There are a host of prior art elements described in the prior art and used for dispensing desired liquids prior to use. Most of these are used with and in a shower arrangement and are described as containing soaps or shampoos or the like. Thus, in these prior art arrangements, the user pushes a button or a release valve to dispense one of the aforementioned liquids prior to using the device during the shower. These prior art instruments use the force of the incoming water through the shower head or faucet to dispense the desired liquid into the water stream. Some of these prior art elements also include a special feature which permits the user to dilute some of the shampoo or soap with incoming water to an unadjustable concentration of fluid through the shower head. Many of these prior art units or elements only provide one or two separate reservoirs for dispensing liquids. Others have a plurality of reservoirs with dangling tubes and are bulky and difficult to use. Most of these elements do not specifically permit the user to adjust the dilution ratio and do not allow the user to alter that ratio at any given time. Additionally, some of these prior art elements, although claiming to be simple and easy to manufacture, have a plurality of parts, features and lines that do indeed make the unit difficult and costly to make and manufacture. Also, a number of these prior art elements or instruments of this type include the shower head or faucet as an integral part of the device itself. Finally, most of these prior art elements are not functional for a plurality of uses. Most of these devices, as previously mentioned, are based on some sort of arrangement for use in a shower or bathtub. None of these elements can be used for alternative reasons.

SUMMARY OF THE INVENTION

It is an object of this invention to provide a unitary, multi-purpose, self-contained element apparatus that can select, dilute at various dilution ratios, mix and dispense a number of solutions and that can be used for a plurality of reasons. It is yet another object of this invention to provide such an element that is functional yet easy to make and manufacture. Yet another object of this invention is to provide such an element with easy to use features such as direct addition or dilution of additive at one of several dilution ratios and mixing of desired ingredients. These and yet other objects are achieved in a unitary, multi-purpose, self-contained apparatus for the selection, dilution, mixing and dispensing of one or more additives, said apparatus being integrally formed by the union of two, complimentary halves defining the space therein, the defined space in said apparatus comprising an inlet for a stream of passing diluent, and an outlet therefor, one or more chambers containing one or more additives connected to said diluent inlet and outlet through an integrated circuit of liquid carrying lines and valves, at least one of said valves on each of said reservoirs having a multi-orifice dilution selector element and at least one of said other valves having an element to select the desired additive, each of said additive chambers having a line to connect said chamber to said valves, an opening for filling said chamber with an additive solution, and a drain outlet for removing any remaining additive solution, whereby when said diluent stream passes into said inlet, one or more of the desired additives at the selected dilution ratio is caused to be pulled into said diluent through one or more of said set of selector valves and to exit through said outlet.

BRIEF DESCRIPTION OF THE DRAWINGS

This invention will become more fully defined and understood from the details given below and from the accompanying drawings, which are tendered by way of illustration only, and thus do not limit the present invention. In these drawings:

FIG. 5 is a detailed showing of one of the additive reservoirs.

FIG. 6 is a detailed showing of an additive selector valve which may be used on the apparatus of this invention.

None of the drawings accompanying this specification are shown particularly to scale. All may have been purposefully enlarged or changed in order to better show all of the desired features contained therein.

DETAILED DESCRIPTION OF THE INVENTION

Figure 1:
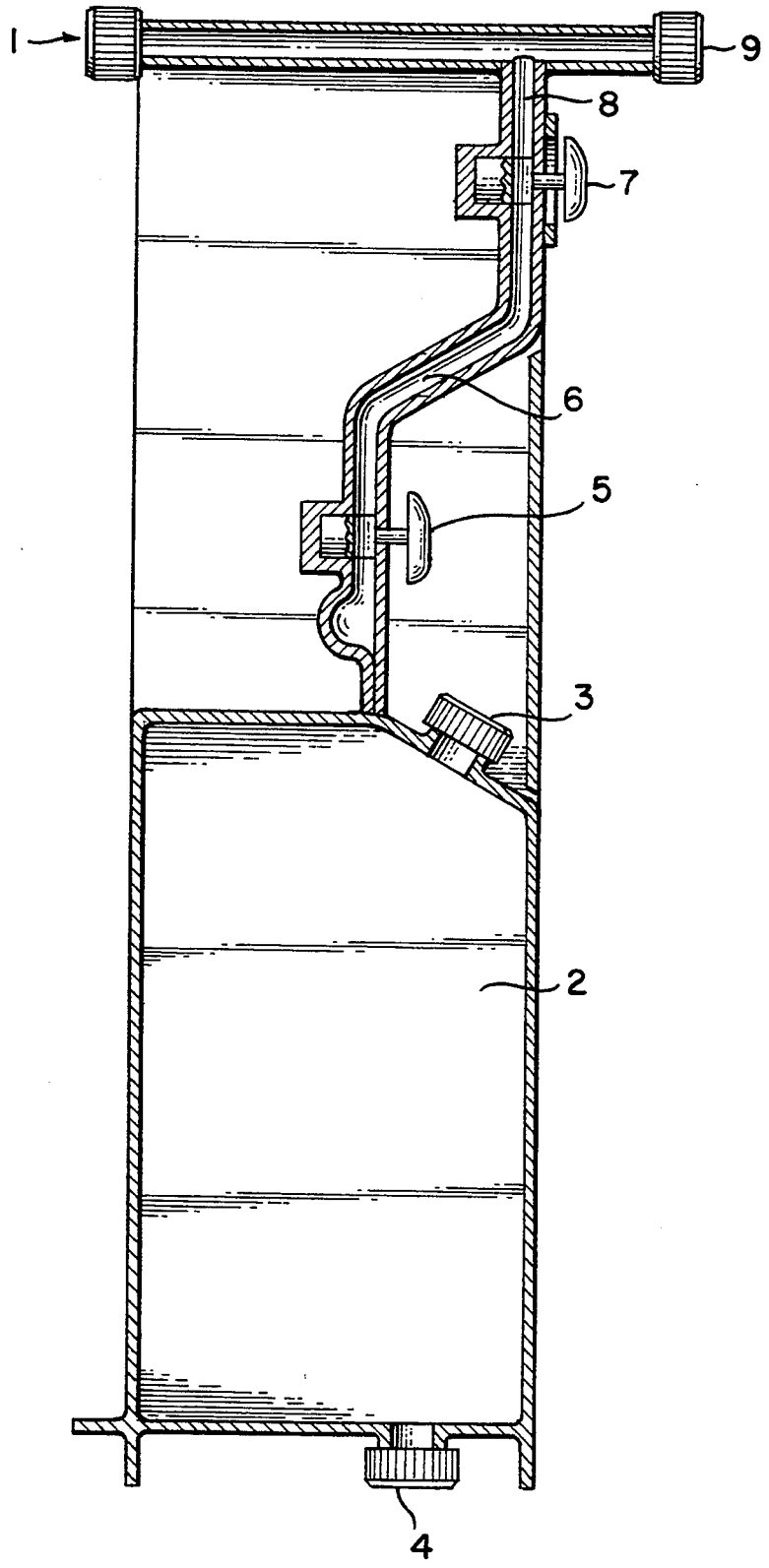
FIG. 1 is a cross-section view of a typical apparatus as defined within this invention. In this view, one can clearly see that the apparatus is made from the union of two, complimentary halves which define the inner portions thereof.

Referring now specifically to the drawings which show the apparatus of this invention as it might be used to select, dilute, mix and dispense ingredients used during a shower, for example, FIG. 1 is a cross-section view of a typical one of these units showing the two, complimentary halves joined to make the inner workings of this apparatus wherein 1 is the inlet as typically attached to a flow of water to a shower head, for example. A reservoir 2 which may contain an additive such as soap, shampoo, hair conditioner, etc. has a filler port 3 and a drain port 4 for adding or removing this additive. With the flow of water in the "on" position, and the selector valve 7 (as described later) set for dispensing the desired additive, a vacuum occurs which will pull up some of the additive from reservoir 2 through a multi-orifice dilution selector valve 5 set at an orifice ratio to give the desired dilution ratio along open channel 6 and through an additive selection valve 7 which is used to select an additive from any one of a plurality of additive reservoirs, not shown in this side view. The additive follows through another channel 8' and is thereby mixed with the water and flows out an exit port 9 to the shower arrangement (also not shown in this viewing). The cross-sectional view in this figure is represented by a non-straight line passing through outlet 9, valves 5 and 7 and reservoir 2.

Figure 2:
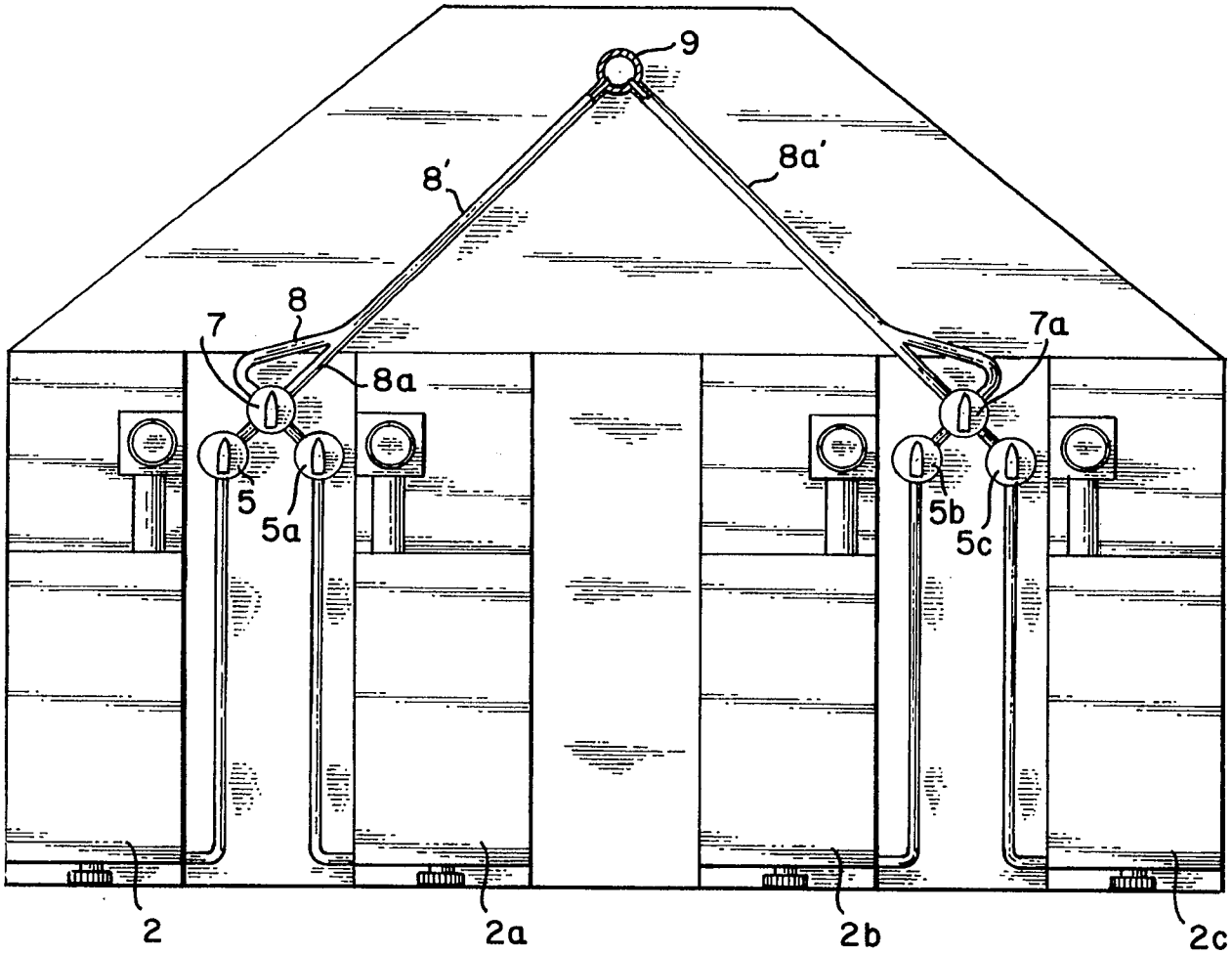
FIG. 2 is a front view of this apparatus. The diluent enters from one port and the diluent/additive mixture leaves from the other port, as will be described below.

FIG. 2 is a front view of FIG. 1 showing four (4) separate reservoirs 2, **2*a*, 2*b* and 2*c*. In this particular view, these reservoirs might hold soap, shampoo, hair conditioner and some other miscellaneous additive (e.g. skin conditioner, for example). The water flows through inlet 1 (not shown since this would be on the opposite side. The outlet or exit port 9 is, however, shown). In this particular showing, each reservoir is equipped with a dilution selector valve 5, 5*a*, 5*b*, and 5*c* and a pair of additive selector valves 7 and 7*a* are used to select the flow from either of a pair of reservoirs. When the water is turned on, and a vacuum created, the user can adjust which material from which reservoir and at which dilution ratio desired to pass into the water stream and out exit port 9** and hence on to the shower (also not shown in this figure).

Figure 3:
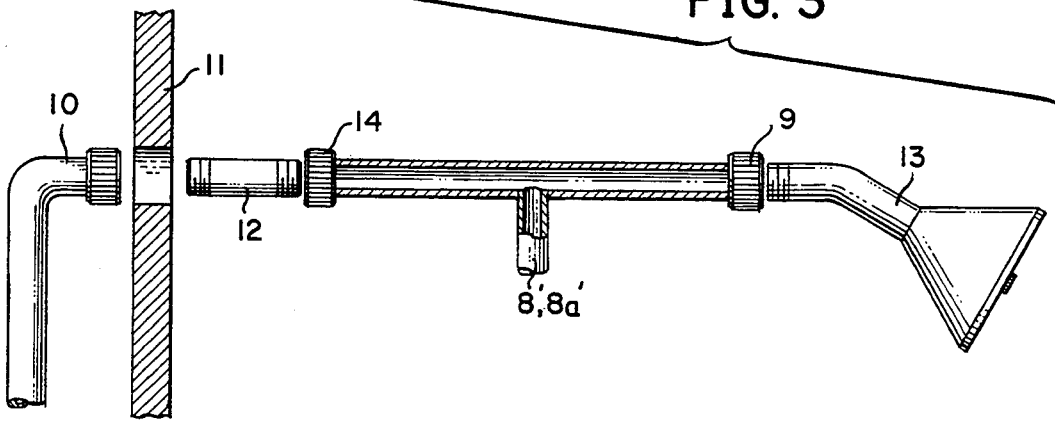
FIG. 3 is a showing of a typical apparatus of this invention as attached to a shower arrangement.

FIG. 3 is a showing of just how a typical apparatus of this invention might be attached to a shower, for example. In this view, the water is conventionally carried through pipe 10 and is connected through wall 11 to a shower head 13. All of this is typical for a conventional shower arrangement. Without the apparatus of this invention, a shower head 13 would normally be attached to the nipple pipe 10 in a conventional manner. However, the apparatus of this invention is placed between the shower head 13 and the pipe 10 using a pipe 12. Thus, the inlet 14 connects to the pipe 12 by screwing on to the pipe in a conventional manner. The shower head 13 then connects to the exit port 9. When water is passed through this device, suction will cause additives to be drawn through channels 8 or **8*a*, and 8'** for example. The body of the apparatus of this invention is not shown further in this view.

Figure 4:
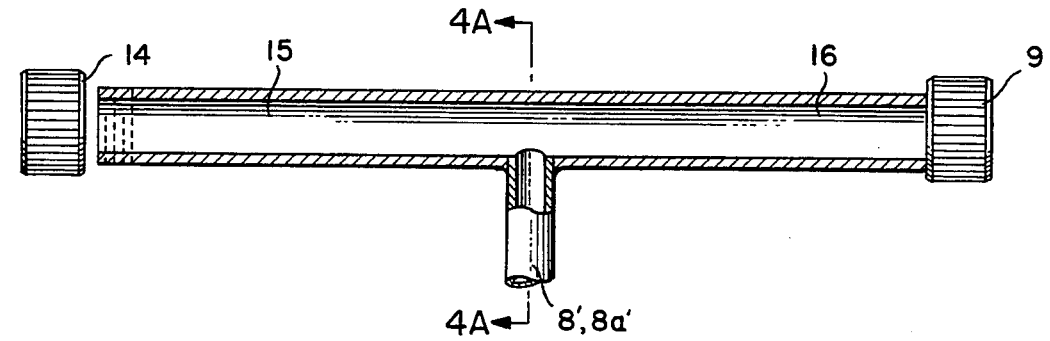
FIG. 4 is a detailed showing of the inlet-outlet arrangement for the diluent flow.

FIG. 4 is a detail showing of that part of the inlet-outlet arrangement from FIG. 3. In this showing, 14 is the inlet connector for attaching to a water source (not shown) and 9 is the outlet therefor. Additives pass up through channels 8' and **8*a*'. Attachment of this arrangement to the water source through 14 or to the shower head (not shown) through 9 can be by conventional means such as a movable nut or hose connection. It is also preferable that the diameter of the inlet tube at 15 be smaller than the diameter of the exit tube at 16 in order to cause a pressure drop and thus promote a vacuum through 8' and 8*a*'**.

FIG. 5 is a typical detail showing of one of the additive reservoirs of this invention, wherein 2 is the reservoir itself, 3 is a filler inlet for the addition of additive thereto, and 4 is a drain for removing additive if required. In this showing, additive is drawn from the reservoir through line 17 and then passed on through the remainder of the equipment (not shown in this view).

Figure 4A:
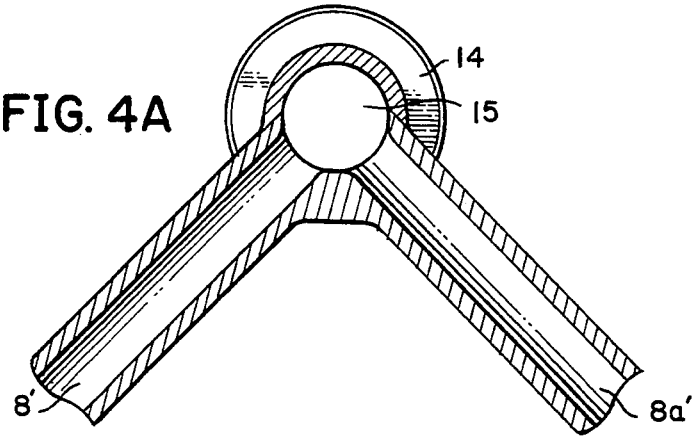
FIG. 4A is a cross-section taken along 4A—4A of FIG. 4.

FIG. 6 is a detailed showing of two of the multi-orifice dilution selector valves 5 and **5*a* attached by channels 6 and 6*a* to the additive selector valve 7. This selector valve can be turned along a bezel 18 so that the desired fluid can be passed along through one or more channels 8 and 8*a* to be mixed with the incoming diluent (not shown in this figure). These channels would then be attached at some point to inlet tube 15 and outlet tube 16 by channel 8' or 8*a*', as shown in FIGS. 4 and 4A**.

Figure 7:
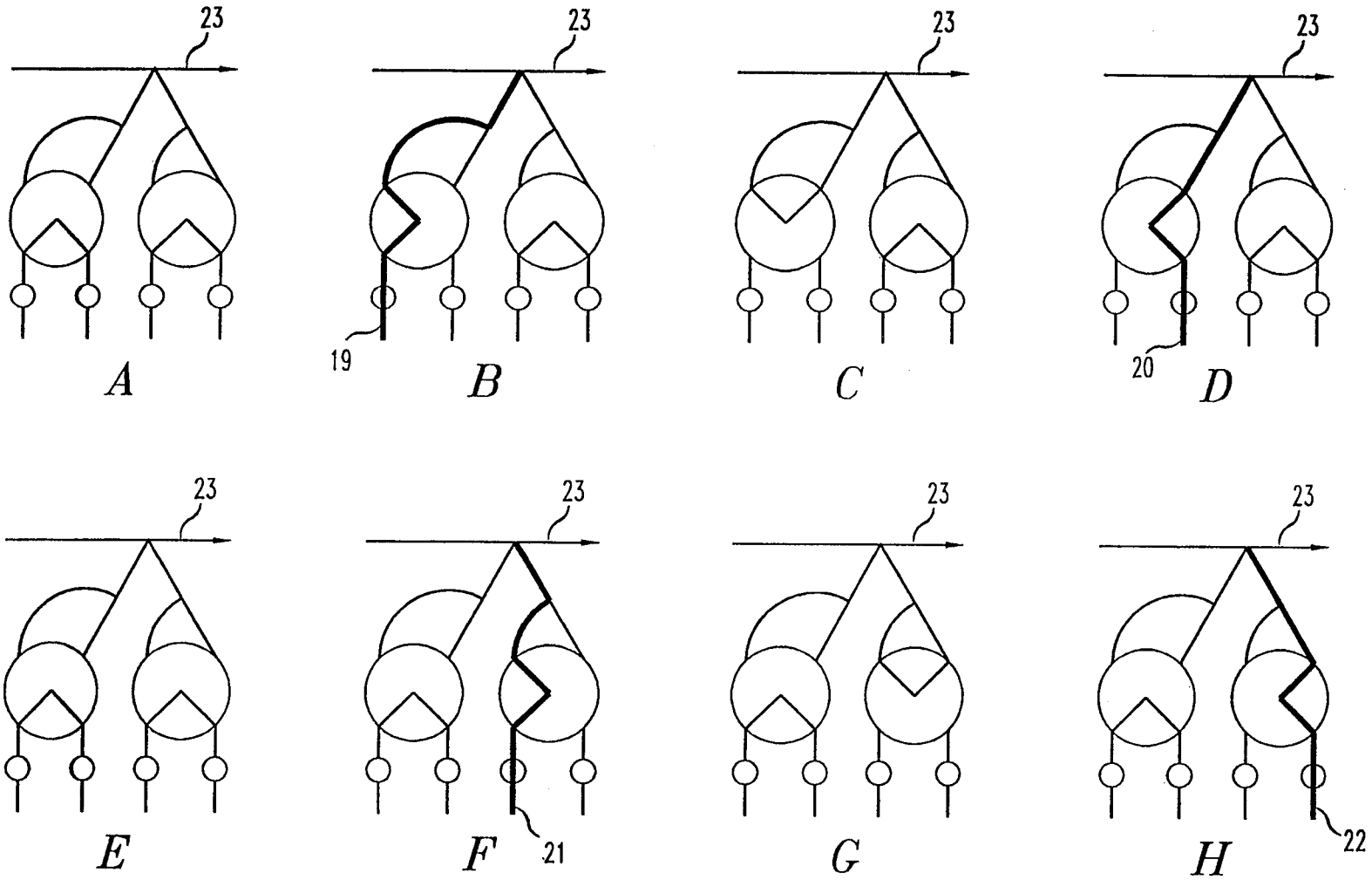
FIG. 7 is a detailed showing of an additive selector valve configuration for the dispensing of additives for a shower. Eight (8) separate positions are shown within this figure.

In FIG. 7, several valve and reservoir configurations are shown for the selection of the various of additives to the diluent stream. This stream, in the case of an apparatus attached to a shower, for example, is represented by an arrow 23 showing the flow of diluent (water) from the inlet to the outlet (not shown in detail here). In the case of the showings in A, C, E, and G, the diluent is simply passing through the inlet and out to the shower head (also not shown herein) without taking any additive thereby. In the case of showing B, soap from a reservoir below is passing through at point 19 and up through the valve to the diluent stream and is thereby incorporated therein. In a like manner D shows shampoo passing up from a reservoir at 20; F shows an additive such as a hair conditioner from a reservoir at 21; and H shows an additive such as body conditioner from a reservoir at 22. Thus, a plurality of additives can be simply added to the incoming diluent as shown by this figure. By adjusting the selector valves and the multi-orifice dilution selection valves it is possible to get the dilution and selection of ingredients as desired.

Figure 8:
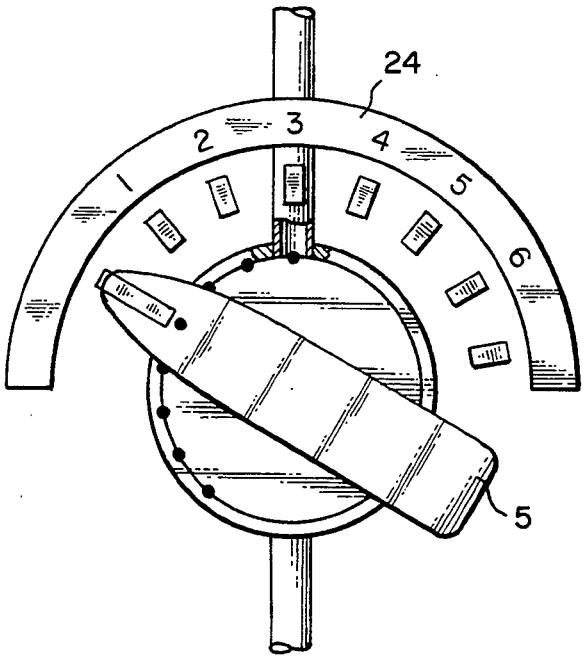
FIG. 8 is a detailed showing of the multi-orifice, dilution sector valve

FIG. 8 is an even more detailed showing of one of the multi-orifice dilution selector valves which has a number of orifice positions shown on the ring 24 in order to increase or decrease the amount of additive passing into the system.

Figure 9:
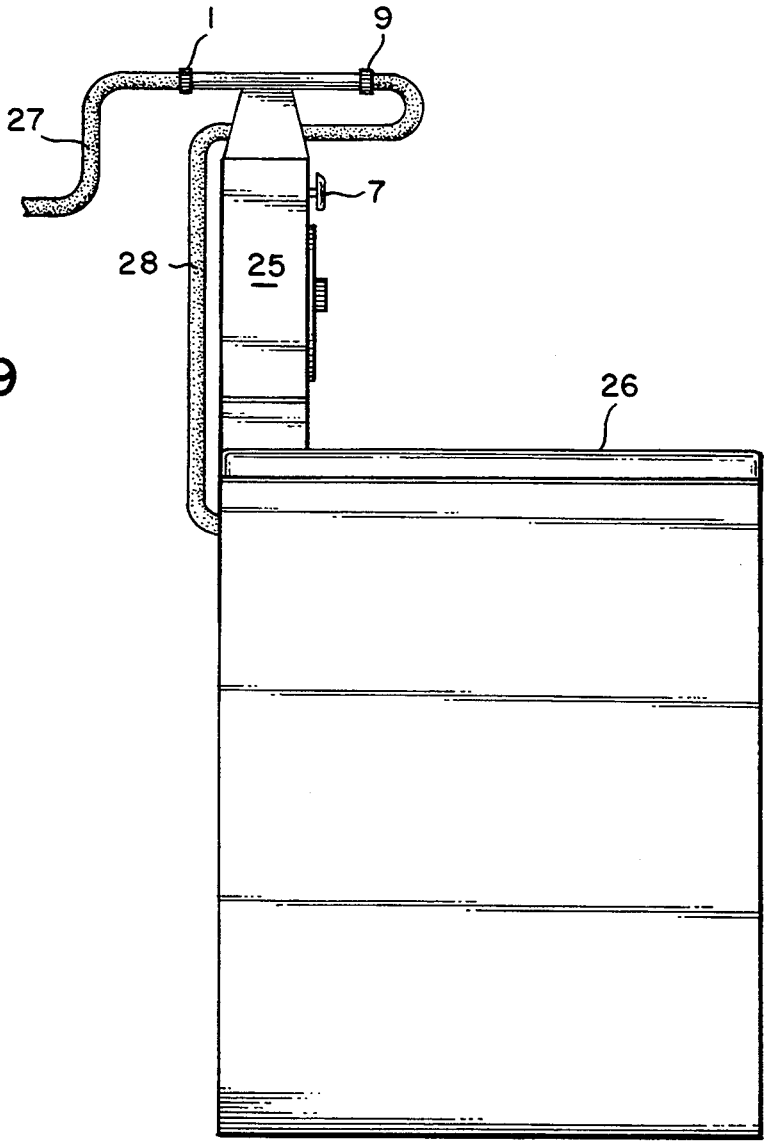
FIG. 9 is a showing of the unitary device of this invention attached to and end use element, such as a dishwasher or washing machine.

FIG. 9 shows the unitary device 25 of this invention connected to an end use element 26, which may be a dishwasher or washing machine, for example. In this particular figure, the inlet 1 is connected by a hose 27 to an incoming dilution stream (may be a water supply, not shown here). After taking in at least one additive from device 25, the stream containing additive then passes into the end use element 26 by use of another hose element 28.

In place of the above mentioned valves, various other conventional devices such as slide bars or push-buttons may be substituted therefor and as a replacement thereof. An appropriate cover may be incorporated within the apparatus to protect the multiorifice dilution selector valves after they have been set and to cover the fill ports, in fact it is so preferred.

As can be seen from an evaluation of the figures and description accompanying these figures, the element of this invention is a unique, unitary unit that is formed by uniting two, complimentary halves which define an integrated liquid line circuitry, more than one additive reservoirs and methods for selecting from these reservoirs and adding solutions contained therein at the desire dilution ratio to an incoming diluent. Although a description of the element of this invention as used along with a shower arrangement has been fully described, it should be noted that this apparatus can be modified for a number of other applications. For example, a unit as defined above can be modified to have use within the embalming field and the reservoirs set up to containing liquids associated therewith. In detail, one reservoir might contain soap for the washing of the body while yet others might contain the appropriate embalming fluid concentrates. A line leading out of the unit would carry the desired solution to the embalming table for use.

In yet another embodiment, this unit can be attached to a sink faucet to select, dilute, mix and dispense hand soap, antimicrobacterial solutions or a pre-wash for dirty dishes and the like. This unit might also dispense dish washing liquid for adding to the sink or dishwasher, for example. By pre-setting the additive ratios and the desired additive, and then turning on the faucet, the exact additive in the exact concentration can thus be achieved. A similar arrangement might be set-up around the clothes washer in order to dispense detergent, bleach, fabric softener and the like. By adding timing devices, matching the cycles of the washing machine, it may be possible to fully automate this entire process. Alternatively, a unit following the teachings of this invention may be built right in the washing machine during the manufacture thereof. In a like manner, modified units of this invention may be incorporated by the manufacturer in to shower and sink fixtures, etc.

An apparatus of this invention might find wide usage within the health industry in order to dispense the desired antimicrobacterial solution, disinfectant and the like, Foot operated or electronic switches attached to the unit might be useful here in starting and stopping the flow of water and thus of the additive from the reservoirs to the water stream.

Yet another apparatus embodiment may find use as a home or professional car washing device to dilute and dispense soap, whitewall cleaner, wax, anti-rust, etc. By attaching a unit to a water hose, the user can dispense these solutions as desired.

Still yet another apparatus embodiment may find use in home or professional lawn care. By attaching a unit having fertilizer, herbicide, insecticide, etc. to an appropriate water source. it is possible to dilute, mix and dispense these fluids as desired in order to treat the lawn or other landscaping.

An apparatus of this invention may also find use within the art field of the treatment of swimming pools, adding ingredients in coin operated machines for the dispensing of fluids such as coffee and soda, for example, adding solutions to aquariums and dispensing fluids within a beauty salon. All of these applications may find wide use of an apparatus as defined and described herein.

The apparatus of this invention can be conveniently manufactured from plastics and the like in order to save weight and manufacturing costs. These materials can easily be formed by molding or blow molding into premade forms as is conventional in the art. Once the appropriate form design is made, the manufacture of the complimentary halves which will be used to define the interior and exterior of the apparatus of this invention, is simple and relatively inexpensive. However, other materials of construction such as aluminum and other light metals may also be used within the scope of this invention. The separately produced, inner additive selector valve bodies (or push-buttons, if that is desired) as well as the inner, multi-orifice dilution selector valve bodies (or slide bars, if that is desired), as well as any other device desired, is placed within the two complimentary halves of the apparatus of this invention prior to the joining thereof. This step may also be used if pressure regulators, rotometers, static mixers and other automation equipment is desired within the equipment for the use defined. After adding all of the extra equipment within the niche or pocket defined therefor, the two halves may be attached together by welding, adhesives, rivets, screws, and the like, or any combination therefor. These steps can embody many conventional techniques.

Each of the preformed reservoirs is fitted with a drain port and a fill port and each of these ports should contain an appropriate cap or other cover. It is preferred that the cap covering the fill port have a vacuum break hole on the top to allow air into the reservoir as the additive contained therein is drawn down.

In addition, the apparatus of this invention may contain a number of safety devices such as pressure relief valves, devices to prevent back flow and the like. These may be highly advantageous when the device is to be used with volatile or dangerous chemicals, for example. Also, several elements of this invention may be connected together in order to increase the number of additive available, depending on the use therefor. The reservoir portion of this apparatus can be a separate unit, sold pre-filled by the manufacturer of the additive, especially for use with dangerous and hazardous chemicals and the like, for example.

In one preferred use, an apparatus of this invention may be hooked to a shower arrangement in order to dispense the various solutions used therewith. The unit is attached between a shower head and the incoming water line using conventional techniques. If the apparatus is to be used by a child, and height is a problem, a lowering or elongating device can be interspersed between the inlet-outlet and the body of the unit, thus putting the unit and the control thereof at a height convenient for a child. A cover is provided over the dilution selector valves and the fill ports. This is then raised and the valves set as desired. These settings may be determined by the user according to the time of use and the dilution ratio of additive desired at that time. Each additive reservoir (see FIG. 2) would be filled with the appropriate additive solution through the filling port. The cover is then closed and the water is turned on. At the appropriate time, the user then turns the additive selector valve to obtain the desired solution at the preset dilution. The flow of water through the inlet to the outlet will draw up the additive open at that time and add that to the water or diluent flowing through the system. At any time desired, the dilution ratio and/or the additive selection may be changed.

As can be seen from the description above, and the figures which exemplify this invention, the unitary, multi-purpose, self-contained selection, dilution, mixing and dispensing apparatus of this invention presents a unique advantage over those of the prior art. The apparatus described is multi-functional and can be used for a wide variety of purposes. It can be easily manufactured and is simple to use. There are no dangling lines and other such elements to interfere with the clean, quick and simple process of adding various liquids to an incoming diluent line. The apparatus be can attached or added to any flow of diluent liquid and a whole host of varied liquids added thereto in any of an almost infinite variety and combinations. The apparatus units can be combined to further increase the utility thereof. All of the liquid circuitry, reservoirs and valving is incorporated within the unit and thus has not been described by the prior art.

I claim:

1. A unitary, multi-purpose, self-contained apparatus for entraining at least one additive in a dilution stream, said apparatus being integrally formed by the union of two complimentary halves, the union of which defines a space therein, the defined space in said apparatus comprising an inlet for said dilution stream, an outlet therefor, and at least one chamber for containing an additive, said at least one chamber being connected to said inlet and outlet through an integrated circuit of liquid carrying lines and valves, each chamber having an opening formed therein for filling said chamber with an additive and a drain outlet for removing additive therefrom, at least one of said valves having a multi-orifice dilution selector element for varying the ratio of additive supplied to the dilution stream, and at least one of said valves having a selecting element for selecting an additive to be supplied to the dilution stream, each chamber being connected to a respective multi-orifice dilution selector element by at least one of said lines and to a respective selecting element by at least one of said lines, whereby when said dilution stream passes from said dilution stream inlet to said dilution stream outlet, the selected ratio of the selected additive is entrained in said dilution stream, with the resulting entrained stream exiting through said dilution stream outlet.

2. The apparatus of claim 1 wherein said apparatus is made from two, integrally formed plastic halves.

3. The apparatus of claim 1 wherein said apparatus is made from two, integrally formed metal halves.

4. An apparatus according to claim 1 wherein said apparatus is portable.

5. The apparatus of claim 1 wherein said inlet is attached to a water source and said outlet is attached to a shower head.

6. The apparatus of claim 1 wherein said inlet is attached to a water source and said outlet is attached to a hose, a washing machine or a dishwasher.

* * * * *